United States Patent [19]

Beeche

[11] 4,234,055

[45] Nov. 18, 1980

[54] MOBILE SUSPENSION SCAFFOLD SYSTEM

[76] Inventor: Gregory L. Beeche, RD #2, Smith Rd., Mechanicville, N.Y. 12118

[21] Appl. No.: 945,103

[22] Filed: Sep. 25, 1978

[51] Int. Cl.[3] ..... E04G 3/10

[52] U.S. Cl. ..... 182/63; 182/118; 182/142; 182/150

[58] Field of Search ..... 182/36, 37, 38, 150, 182/63, 118, 119, 130, 17, 142

[56] References Cited

U.S. PATENT DOCUMENTS

| | | | |
|---|---|---|---|
| 3,608,670 | 9/1971 | Blake | 182/63 |
| 3,854,550 | 12/1974 | Shingle | 182/36 |
| 3,900,080 | 8/1975 | Rea | 182/36 |
| 3,937,301 | 2/1976 | Bertail | 182/63 |
| 4,096,922 | 6/1978 | Fisher | 182/36 |

*Primary Examiner*—Reinaldo P. Machado
*Attorney, Agent, or Firm*—Heslin, Irwin & Nieman

[57] ABSTRACT

A mobile siding scaffold system which comprises a roof vehicle and a scaffold. The roof vehicle is mounted on castors. Attached to the vehicle frame and extending over the front of the frame are two telescoping booms. These booms are provided with cables and suspension beam connection points, and enable the scaffolding to be carried along the sides and around the outside corners of buildings without the need to disassemble the scaffold. Adjustable outriggers are mounted on the frame so as to be able to extend in front of the frame for stability to prevent the weight of the scaffolding from upending the frame. For further stability, telescoping arms provided with counterweights may be mounted on the frame, so as to extend out to the rear of the frame. The scaffold includes the following: A horizontal platform suspension beam, which may be fastened to the cables and fastened to the support beam connection points, has holes aligned with the cables to allow the cable to pass through. Four vertical support columns having a plurality of platform connection points, are mounted at predetermined locations on the platform beam. Platforms, which may be attached to the platform connection points and to the cables, have holes aligned with the cables to allow them to pass through.

19 Claims, 11 Drawing Figures

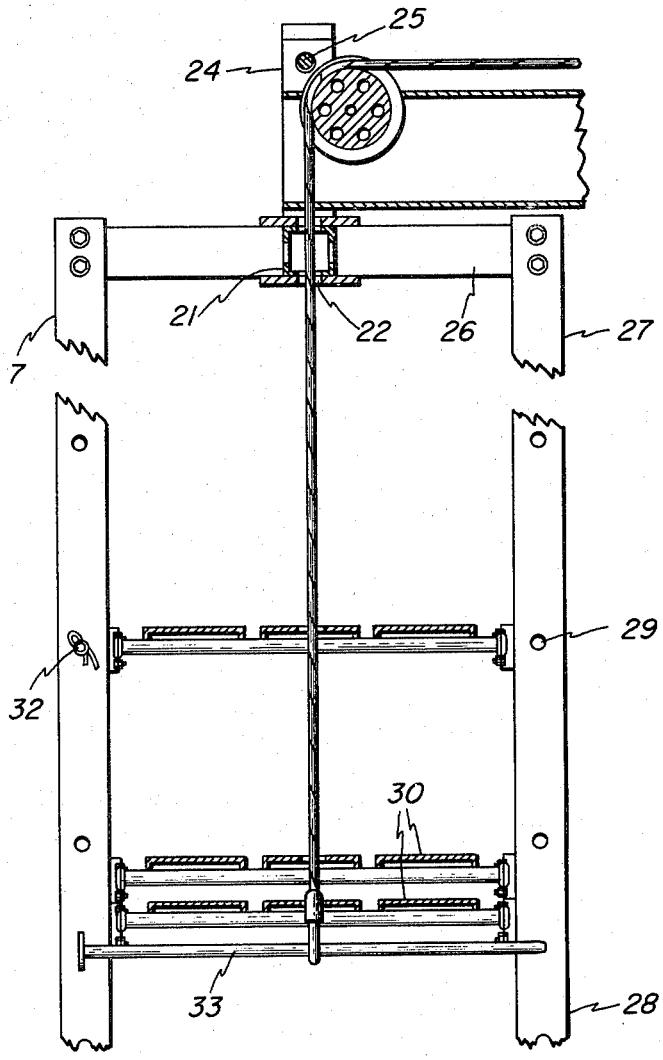
FIG. 4
FIG. 5
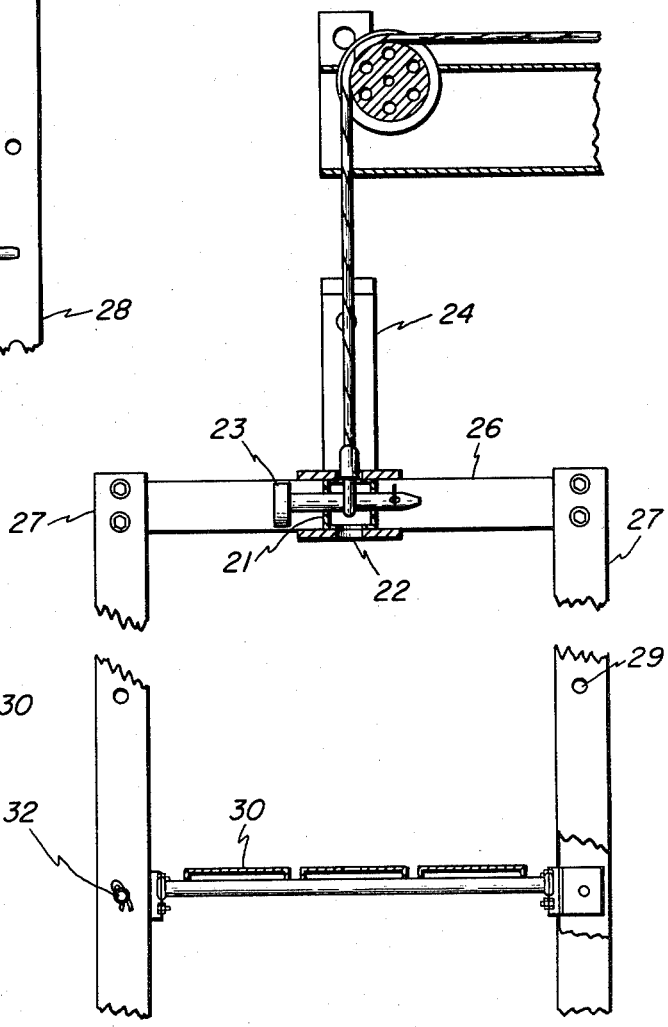
FIG. 6
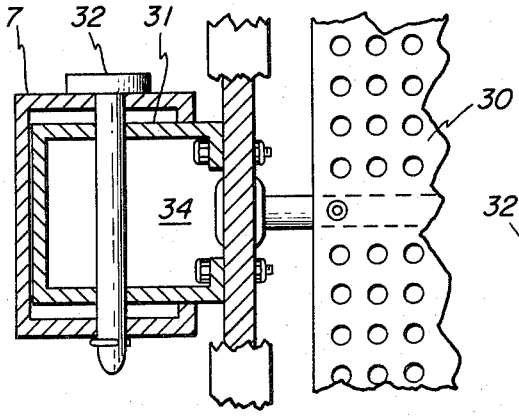

MOBILE SUSPENSION SCAFFOLD SYSTEM

BACKGROUND OF THE INVENTION

The present invention relates to suspension scaffold systems generally, including those having mobile roof vehicles.

Scaffolding systems have long been used to provide artisans with a suitable area from which they can work on the sides of buildings. Such scaffolding systems are used for a wide variety of purposes, ranging from use in applying siding to buildings under construction, to use in washing the windows of a completed building.

For instance, in building a conventional factory of rectangular configuration with a flat roof, metal wall panels must be installed on four walls. Using conventional scaffolding, the builder would construct the scaffolding along a first wall, fasten the metal panels into place, and then totally disassemble the scaffolding. This procedure would be repeated for each of the remaining three walls. Therefore, in such a rectangular building, the entire scaffolding must be assembled four times and disassembled four times. Many man-hours are expended on disassembling and rebuilding the scaffolding each time it needs to be moved. Great monetary savings, in the costs of operations which require scaffolding, can be realized if the need to continually disassemble and then reassemble the scaffolding, whenever it must be moved, can be eliminated or reduced.

It would be advantageous to provide a suspension scaffold system which would need to be assembled only once at the beginning of each job, which would need to be disassembled only once at the end of each job, and which could be easily moved along the sides of the buildings under construction during performance of the job.

Another disadvantage associated with conventional scaffolding concerns the relative difficulty encountered in suspending a plurality of work platforms from an overhead fixture. Typically, vertical ladders are provided for holding the ends of the work platforms and workmen scale these ladders in order to attach the work platforms in place. This procedure is fairly risky as concerns the safety of the workmen.

Another disadvantage associated with conventional suspension scaffolding concerns the extension and retraction of the booms or overhead fixtures from which the scaffolding is hung. This presently is accomplished by disassembling the scaffolding, or, where movable booms are provided, by having workmen manually push and pull the booms. This, of course, involves a significant degree of physical exertion inasmuch as the weight of the scaffolding and the booms themselves is considerable. It would be advantageous if a system were provided which could utilize the mechanical advantage afforded by conventional cable jacks normally found around scaffolding sites.

SHORT STATEMENT OF THE INVENTION

It is an object of this invention to provide a suspension scaffold system, having a mobile roof vehicle which would permit the scaffold to be moved along the side of a building and around corners, without being disassembled.

It is a further object of this invention to provide a suspension scaffold system in which a plurality of work platforms can be disposed at preselected levels through utilization of the suspension system itself.

It is a further object of this invention to provide a suspension scaffold system in which the cables and cable jacks thereof can be utilized to extend and retract the booms of a mobile suspension vehicle.

Finally, it is an object of this invention to provide a mobile suspension scaffold system in which the scaffolds can be assembled from the top down or from the ground up.

The present invention is a mobile suspension scaffold system comprising a roof vehicle and suspension scaffold. The roof vehicle is mounted on castors, allowing the vehicle to be rolled in any direction on the supporting surface of the roof. Two telescoping booms which support the scaffolding are mounted on the vehicle frame and extend over the front of the frame. These booms are provided with cables and suspension beam connection points. The telescoping feature is necessary in order to carry the scaffold around the outside corners of buildings without the need to disassemble the scaffold.

Hinged outriggers, pivotally mounted on the frame, swing out in front of the frame while in use and swing alongside the frame when not in use. Jacks are provided on the ends of the outriggers, for stability, to prevent the weight of the scaffold from upending the frame.

Telescoping arms provided with counterweights may be mounted on the frame so as to extend out to the rear of the frame. These counterweights add more stability so as to prevent the weight of the scaffold from upending the frame.

The scaffold includes a platform suspension beam, vertical support columns and work platforms. The horizontal platform suspension beam, which may be fastened to the cables or fastened to the suspension beam connection points on the booms, has holes aligned with the cables to allow the cable to pass through. Four vertical support columns are mounted at predetermined locations on the platform suspension beam. The columns have a plurality of platform connection points. Work platforms are attached to the platform connection points.

A system of sheaves is provided on the booms and the framework of the roof vehicle, which enable the suspension cable to be utilized in extending and retracting the booms.

BRIEF DESCRIPTION OF THE DRAWINGS

FIG. 4 is a cross-sectional view of the siding scaffold with the platform support beam pinned to the boom, wherein the cross-section is cut along the center line of a boom and cable.

FIG. 5 is a cross-sectional view of the siding scaffold being supported by the cables pinned to the platform support beam, wherein the cross-section is cut along the center line of a boom and cable.

FIG. 6 is a cross-sectional view of a vertical support column looking down into the column, with a platform pinned to the column. The cross-section is cut through the center line of the pin.

DETAILED DESCRIPTION OF THE INVENTION

Figure 2:
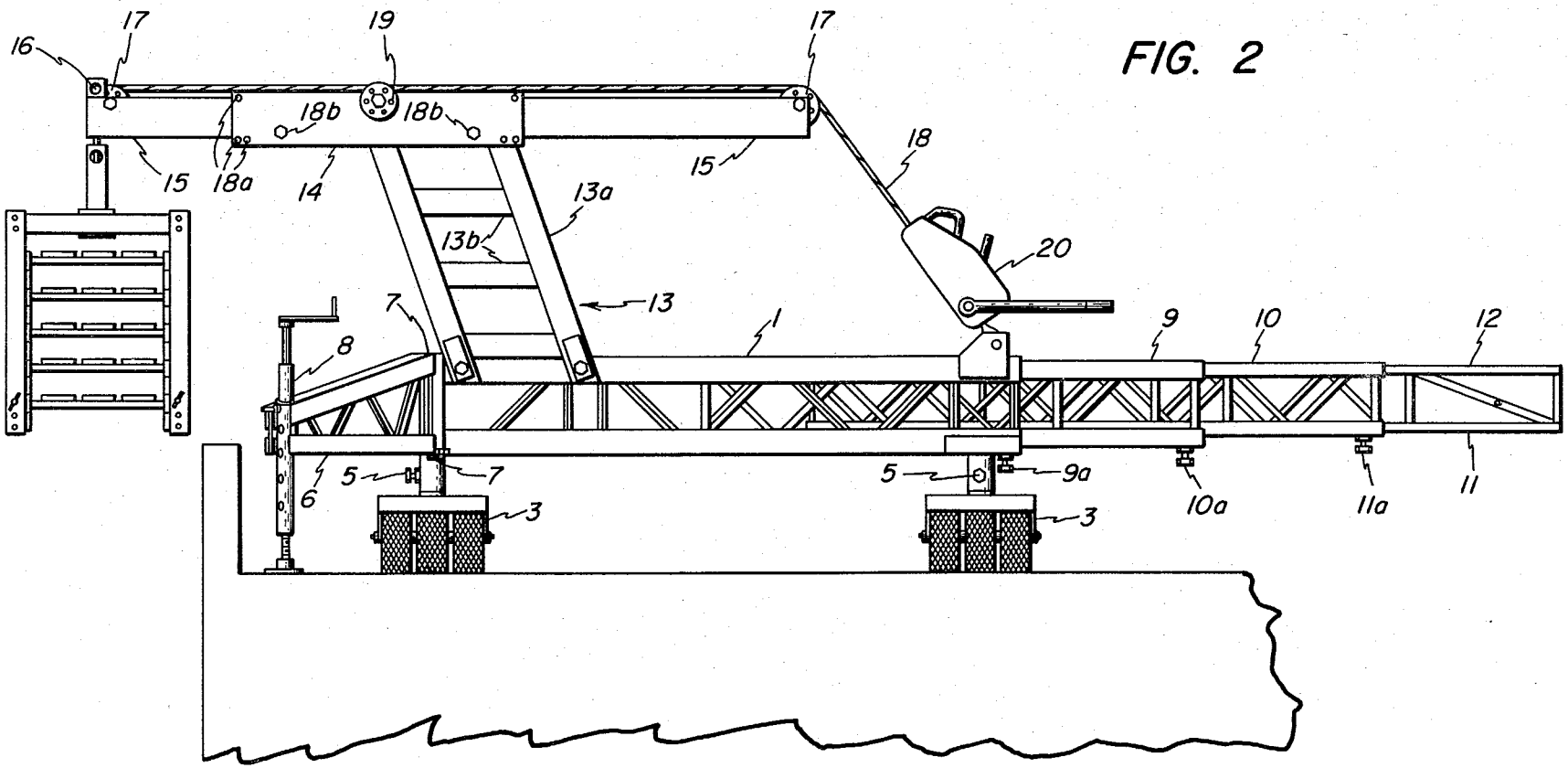
FIG. 2 is a side elevation view of the mobile roof vehicle holding a collapsed siding scaffold.
Figure 3:
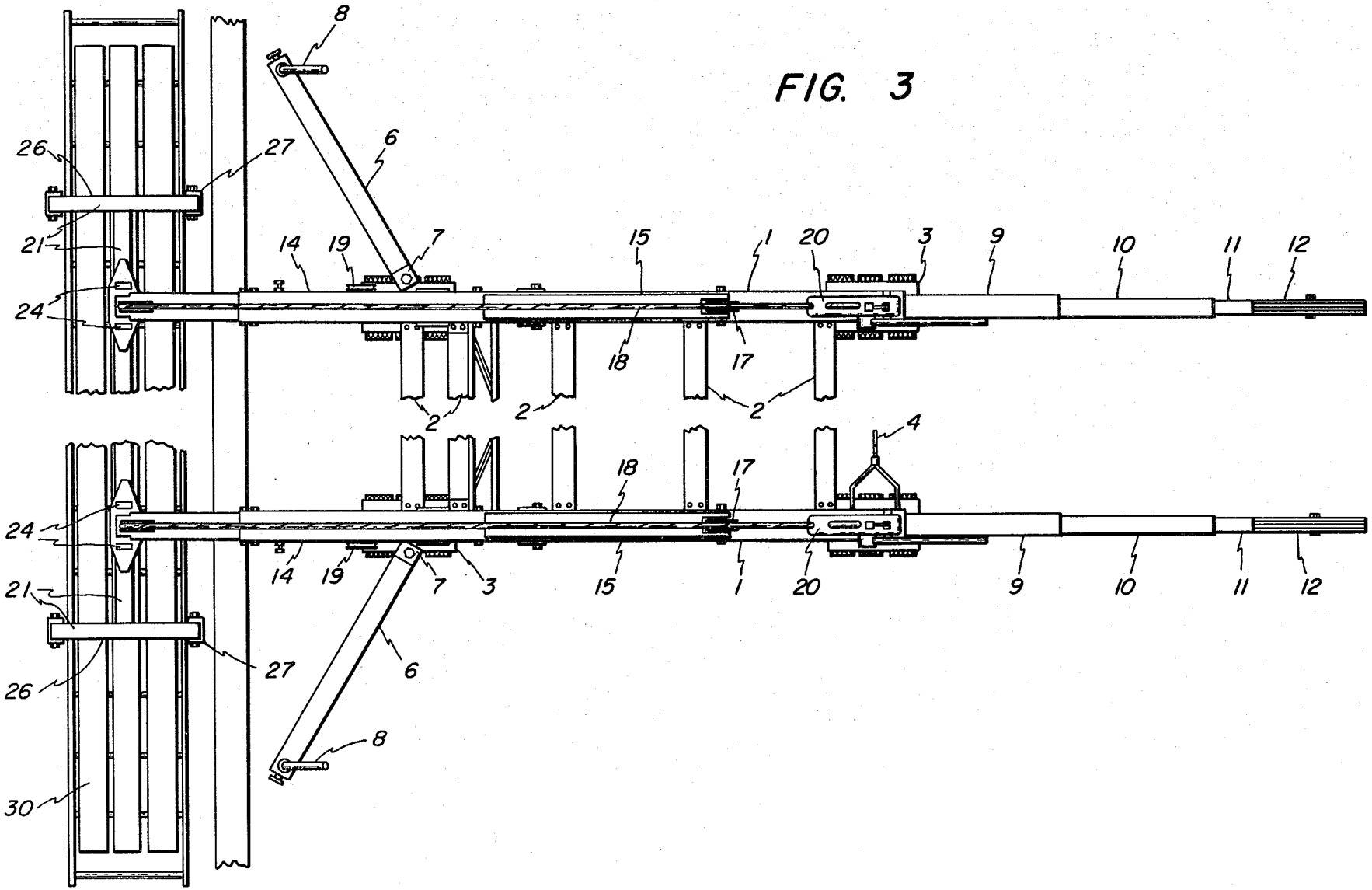
FIG. 3 is a top plan view of the mobile roof vehicle holding the siding scaffold.

Referring to FIGS. 2 and 3, the mobile roof vehicle includes a framework of main trusses 1 and cross-trusses 2. These are bolted together in a conventional manner by bolts which are not shown. The framework is mounted on castors 3. The axis of each castor 3 is perpendicular to the surface of the roof and each castor can rotate 360° around its axis. Each castor 3 is provided with a steering and brake handle 4 (shown on only one castor in FIG. 3) and a steering lock 5 (FIG. 2). Each castor 3 is keyed to lock into predetermined positions for specific maneuvers.

Outriggers 6 are connected to the trusses 1 by hinges 7 to allow 180° rotation of the outrigger around the axis defined by the hinges. Jacks 8 are mounted on the ends of outriggers 6 to contact the surface upon which the vehicle is operating.

Extending rearwardly from within main trusses 1 are telescoping counterweight arms, which include outer counterweight arms 9, medial counterweight arms 10 and inner counterweight arms 11. At the ends of inner counterweight arms 11 are counterweights 12. Counterweights 12 are fastened in place by counterweight straps (not shown). Inner arms 11 slide within medial arms 10, which slide within outer arms 9, which slide within main trusses 1, when full counterweighting is not needed. Locks 9*a*, 10*a* and 11*a* are provided for locking arms 9, 10 and 11, respectively, into place.

Extending upwardly, the framework also includes boom supports 13, made up of members 13*a* and 13*b*. The boom supports elevate the booms with respect to the rooftop, allowing the booms to pass over any parapet which might be on the roof. The telescoping booms include boom sleeves 14, which are rigidly attached to boom supports 13 and booms 15, which are mounted to slide longitudinally within boom sleeves 14. The front ends of booms 15 have suspension beam connection points. Preferably, these connection points are in sockets 16.

Boom sheaves 17 are mounted at each end of booms 15 for use with the cable 18. Idler sheaves 19 are mounted on boom sleeves 14 also for use with the cables 18. Rollers 18*a* are mounted on boom sleeves 14. Lock screws 18*b* are mounted on sleeves 14 to lock booms 15 in place.

Cable jacks 20 are mounted on top of the rear framework and are of conventional design.

Figure 1:
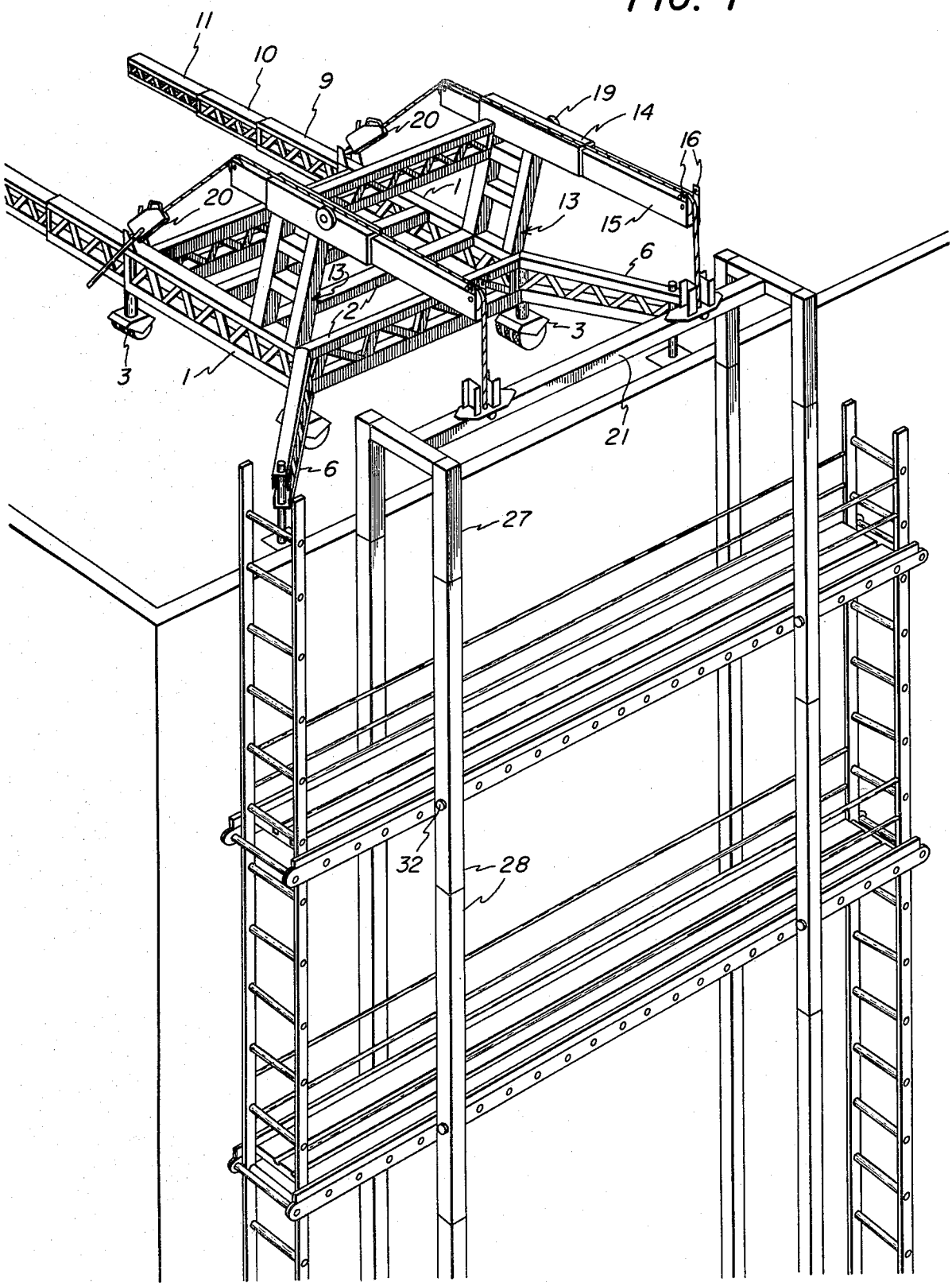
FIG. 1 is a perspective view of the mobile roof vehicle holding the siding scaffold.

FIGS. 1, 2 and 3 show the operation of the mobile roof vehicle when it is supporting a fully loaded scaffold. Outriggers 6 are swung out from the frame so as to position jacks 8 to the front and to the side of the frame. Jacks 8 are adjusted to come in contact with the roof. It is apparent that the whole vehicle acts as a lever and that outriggers 6 coupled with jacks 8 are the fulcrum. The object to be lifted by the lever is the scaffold. Therefore, as the fulcrum (defined by jacks 8) is moved closer to the scaffold, less weight is needed on the other end of the lever to support the scaffold. The counterweight arms 9, 10 and 11 are extended to give added length to the lever. This further increases the capability of counterweight 12 to support the weight of the scaffold.

To move the scaffold along the side of the building, all excess weight is removed from the scaffold, jacks 8 are lifted, castors 3 are all locked into a position to roll parallel to the edge of the building, and the castor brakes are released. Any suitable means may be employed to move the mobile roof vehicle and thereby carry the scaffold with it. If there are obstructions on the roof, counterweight arms 9, 10 and 11 may be retracted and outrigger 6 may be folded alongside the frame, thereby making the mobile roof vehicle very compact.

Figure 9C:
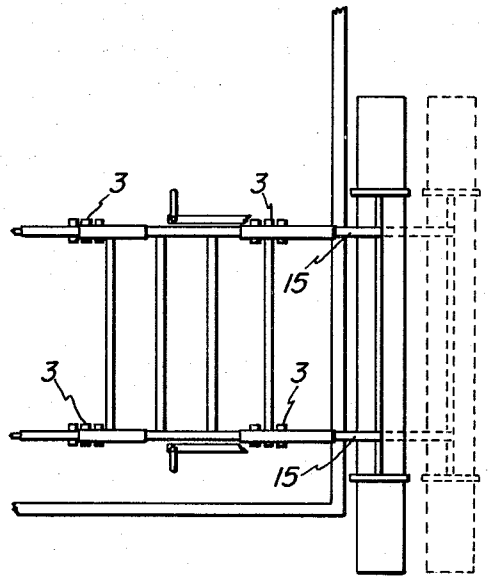
FIG. 9*c* is a top plan view of the mobile roof vehicle holding a scaffold. The assembly has completed turning the outside corner. The previously extended booms are in phantom.
Figure 9B:
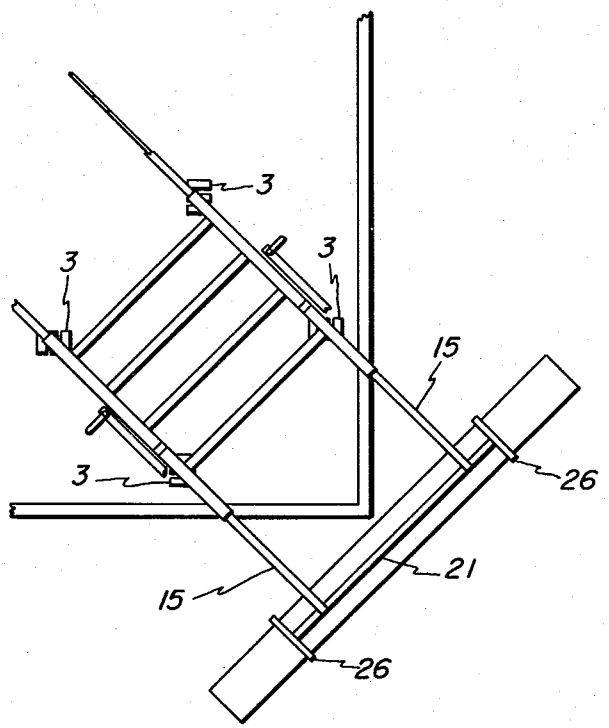
FIG. 9*b* is a top plan view of the mobile roof vehicle holding a scaffold with the telescoping booms extended. The assembly is in the process of turning an outside corner.
Figure 9A:
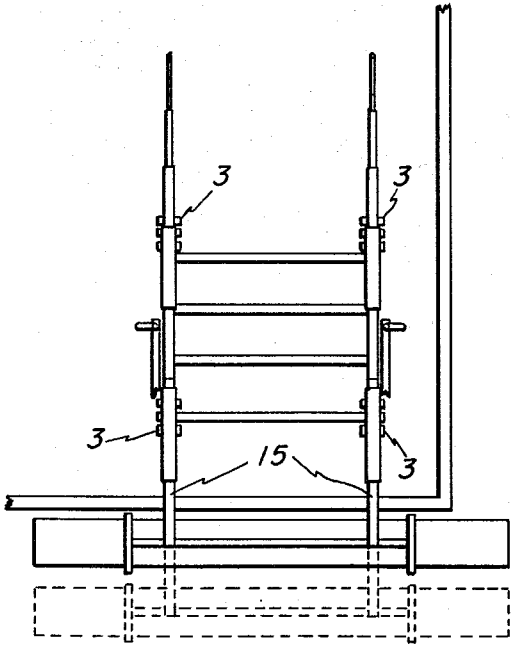
FIG. 9*a* is a top plan view of the mobile roof vehicle holding a scaffold with the telescoping booms extended in phantom. The assembly is approaching an outside corner.

Referring now to FIGS. 9*a*, 9*b* and 9*c*, the mobile roof vehicle can be seen approaching an outside corner in FIG. 9*a*. At this point, booms 15 are extended. Castors 3 are locked into position, as shown in FIG. 9*b*, to enable the mobile roof vehicle to rotate around its central axis and thereby turn the corner. The castors are preferably keyed to lock into this position for this maneuver. In FIG. 9*c*, the mobile roof vehicle has completed turning the corner. Boom 15 has been retracted, and castors 3 are locked into position to enable the vehicle to travel parallel to the new wall.

Figure 7:
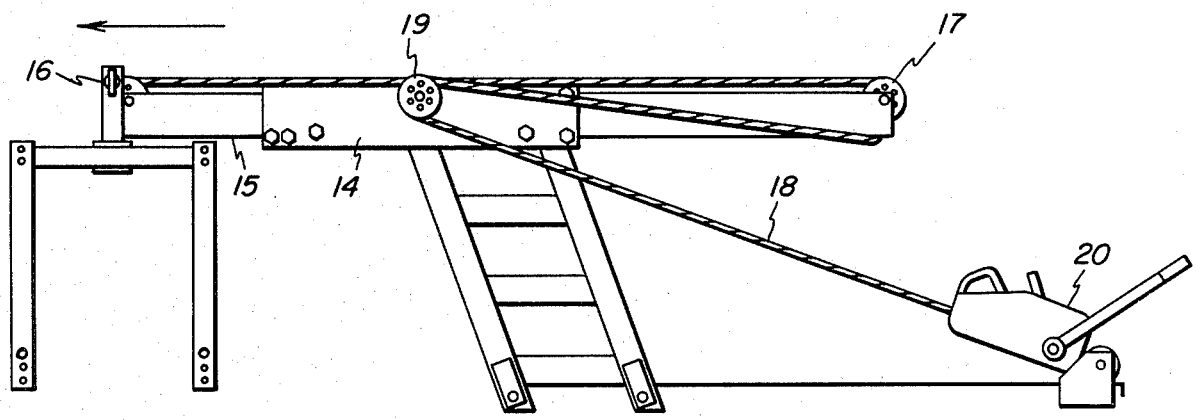
FIG. 7 is a side elevation view of the upper portion of the mobile roof vehicle showing the cable arrangement for extending the booms.

FIG. 7 illustrates the cable arrangement for extending the booms (to the left in this figure). Cable 18 coming from cable jack 20 is first threaded clockwise around idler sheave 19. Cable 18 is then threaded counterclockwise around boom sheave 17, attached to the rear of the boom, and then is pinned to the front of boom 15 at pin sockets 16. When the cable is drawn through cable jack 20, the boom is then pushed forward.

Figure 8:
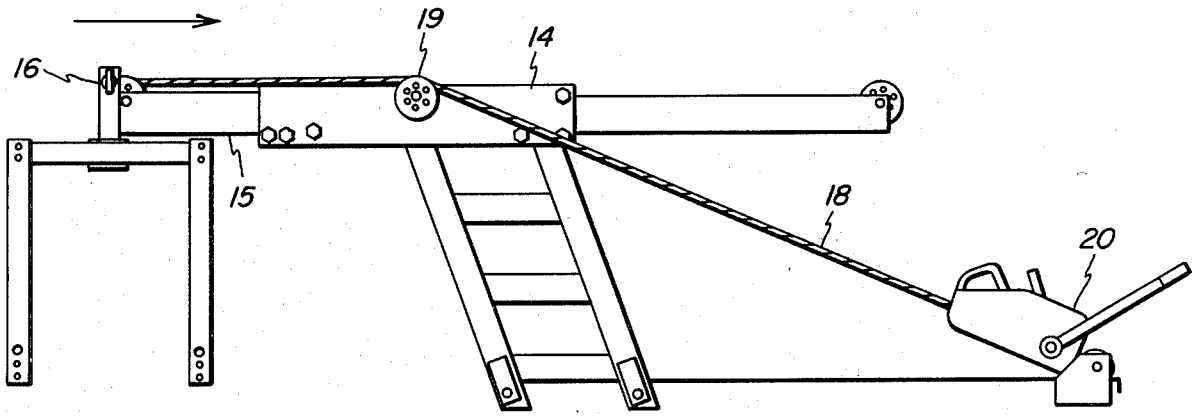
FIG. 8 is a side elevation view of the upper portion of the mobile roof vehicle showing the cable arrangement for retracting the booms.

FIG. 8 illustrates the hoist cable arrangement for retracting the boom (to the right in this figure). From cable jack 20, cable 18 is threaded counterclockwise over idler sheave 19, which is attached to sleeve 14. Cable 18 is then pinned to the front of boom 15 at pin sockets 16. When the cable is drawn through cable jack 20, the boom is retracted.

Referring to FIGS. 3, 4, and 5, it can be seen that the scaffold includes platform suspension beam 21 with holes 22, aligned such that when beam 21 is pinned to booms 15, and the cables are dropped straight down from the front boom sheaves, cables 18 will pass vertically down through the support beam 21. Alternatively, beam 21 may be fastened to cables 18 by passing the cables through holes 22 and then using suspension pins 23 (see FIG. 5). Platform suspension beam 21 is also provided with ears 24 which may be aligned with pin sockets 16, in booms 15. This arrangement is provided to enable the platform suspension beam to be fastened to the suspension beam connection points on booms 15. FIG. 4 illustrates platform suspension beam 21 pinned to booms 15 via boom pins 25. Suspension beam 21 has a cross-member 26 at each end, as can be seen clearly in FIG. 9*b*.

Vertical support columns 27 are bolted to each end of each cross-member 26, and column extension members 28 are bolted to the ends of columns 27 until the desired height of the scaffold is reached. Each column 27 and extension 28 is provided with an internal channel communicating with an opening or slot 34 running its full length (see FIG. 6), and with platform connection points in the form of holes 29 at one foot intervals. The columns 27 and extensions 28 must be bolted together in alignment, such that the slot 34 runs the entire length of all the beams, without interruption.

As shown in FIG. 6, platforms 30 are provided with runners 31, which slide in the slot 34 within the columns and extensions, 27 and 28. Column Pins 32 may be passed through the columns or extensions, 27 and 28, and through the runners 31, so as to fasten the platforms to the platform connection points. Runners 31 are bolted to the platforms 30, but may be fastened in other conventional ways. Platforms 30 also have holes 30*a*, aligned such that when platforms 30 are pinned to the platform connection points 29, and the cables are dropped straight down from the front boom sheaves 17, cables 18 will pass vertically down through the platforms. Cables 18 may be fastened to a platform by passing the cables through holes 30*a* and then, as shown in FIG. 4, by using platform pins 33.

To assemble the siding scaffold on the roof, after all components have been brought up to the roof, platforms 30 are stacked one on top of the other. Next, the suspension beam 21, with four columns 27 attached, is placed over the stack of work platforms 30. The bottom work platform 30 is pinned to column 27 using column pins 32. The mobile roof vehicle is rolled into position over suspension beam 21 so that cable 18 may be lowered and pinned to the beam in the manner shown in FIG. 5, using cable pins 23. Beam 21 is raised to booms 15 and is then pinned to the booms in the manner shown in FIG. 4, using boom pins 25. The mobile roof vehicle is then rolled toward the edge of the roof so that the front two columns 27 are just clear of the roof edge. The appropriate number of extension members 28 are assembled and bolted to the front two columns 27. The mobile roof vehicle is rolled further so that the back two columns 27 are just clear of the roof edge. The appropriate number of extensions 28 are assembled and bolted to the back two columns 27. At this point, the cables 18 are unpinned from the suspension beam 21 and run straight down through the holes 22 in the support beam 21 and through the holes 30*a* in the work platforms. Then, as in FIG. 4, cables 18 are pinned to the bottom work platform 30 via platform pins 33. Column pins 32, which secured the bottom work platform to the column 27, are removed and the stack of work platforms is lowered until the top platform is at the desired height. As shown in FIGS. 4 and 6, the top work platform is pinned to the columns 27 or extensions 28, as the case may be, by pins 32, and the remaining stack of platforms is lowered. This process is repeated until all platforms have been pinned at their desired heights. After the bottom platform is pinned in place, cables 18 are unpinned and are drawn to the top.

To assemble the scaffolding from the ground, after the mobile roof vehicle has been brought up to the roof, the desired number of work platforms are stacked on the ground next to the building and parallel to it. The suspension beam 21 and four columns 27 attached is placed over the stack of platforms and the bottom work platform is pinned to the columns 27 by column pins 32. The cables 18 are lowered from the mobile roof vehicle and pinned to the beam 21 by means of cable pins 23. The beam 21, columns 27 and platforms 30 are raised high enough so that four extensions 28 can be bolted on to the ends of the columns 27. The process of raising the platforms is continued until the desired number of extensions 28 have been bolted in place. After the desired number of extensions have been attached, the suspension beam 21 is raised and pinned to the booms 15. Finally, the work platforms are lowered into place using the same method as described for assembling the scaffolding from the roof.

To move the scaffold along an inside corner, partial disassembly is necessary. Cables 18 are passed through holes 22 in suspension beam 21 and through holes 30*a* in all platforms 30, and are then pinned to the bottom platform, using platforms pins 33, as shown in FIG. 4. This bottom platform is unpinned from the column extension members 28, by removing pins 32, and raised until it reaches the next platform. The next platform is unpinned and raised, and this process is repeated until all platforms are raised into the vertical columns 27. Now the extension members 28 are removed and the mobile roof vehicle is ready to turn the inside corner.

What is claimed is:

1. A mobile roof vehicle for use with a mobile scaffold system comprising:

a frame mounted on castors to allow universal rolling motion of the frame on the roof surface, said frame having a front, a rear and sides;

at least one telescoping boom attached to the frame and extending beyond the front thereof, said boom being adapted to hold scaffolding suspended therefrom;

means attached to each boom for suspending a scaffold-supporting cable therefrom; and means attached to each boom for receiving and holding a scaffold-supporting pin.

2. The invention of claim 1 wherein the telescoping boom comprises:

a boom sleeve connected to the frame, said sleeve having an idler sheave mounted thereon; and a boom, slideably mounted within the boom sleeve, having a boom sheave mounted at the rear end of the boom and another mounted at the front end.

3. The invention of claim 1 or 2 further comprising at least one telescoping arm provided with a counterweight on one end, its other end being mounted on the frame, and at least one outrigger pivotally mounted on the frame so as to be able to extend beyond the front and beyond a side thereof.

4. The invention of claim 3 wherein the casters are provided with brakes and are keyed to lock into predetermined positions for specific maneuvers to be performed by the roof vehicle.

5. A mobile roof vehicle according to claim 4, wherein the frame further comprises boom supports which maintain the telescoping booms elevated with respect to the surface of the roof.

6. A suspension scaffold for use under a fixture having two suspension cables and two suspension beam connection points comprising:

a suspension beam adapted to be selectively connected to the suspension cables and the suspension beam connection points;

at least two vertical support columns suspended from the suspension beam;

a plurality of work platforms adapted to be connected at preselected levels to the vertical support columns; and means for suspending the platforms from the cables when the platforms are not connected to the columns, whereby the platforms may be vertically moved by means of the cables independently of the suspension beam and vertical columns when the beam is connected to the fixture connection points.

7. The invention of claim 6 wherein the columns are provided with an internal channel communicating with a longitudinal slot, said columns also having pairs of holes therein at said preselected levels for receiving pins and wherein the work platforms are provided with runners adapted to slide within the channels and wherein pins are inserted in said pairs of holes and through the runners of individual platforms for supporting same.

8. The invention of claim 7 wherein the suspension beam may be connected to the connection points or the cables by means of pins.

9. A mobile suspension scaffold system for use with an elevated supporting surface comprising:

a mobile vehicle adapted to move about on the supporting surface;

at least one retractable boom mounted on the vehicle and adapted to overhang the space to be scaffolded;

at least one vertical support column for holding work platforms;

at least one work platform adapted to be connected at preselected levels to the vertical support column;

first means for selectively suspending the column and the platform from the boom; and second means for suspending the column from the boom.

10. The invention of claim 9 wherein each vertical support column is provided with an internal channel communicating with a longitudinal slot, said columns also having pairs of holes therein at preselected levels for receiving pins and wherein each work platform is provided with runners adapted to slide within the channels and wherein pins are inserted in said pairs of holes and through the runners of individual platforms for supporting same.

11. The invention of claim 10 wherein the first means comprises at least one suspension cable suspended from each boom.

12. The invention of claim 11 wherein the second means comprises pin means.

13. The invention of claim 12:

wherein the mobile vehicle comprises a frame mounted on castors to allow universal rolling motion of the frame on the roof surface, said frame having a front, a rear and sides; and further comprising:

at least one outrigger, pivotally mounted on the frame so as to be able to extend beyond the front and beyond a side thereof;

at least one telescoping arm provided with a counterweight on one end, its other end being mounted on the frame.

14. A mobile suspension scaffold system for use with an elevated supporting surface comprising:

a mobile vehicle adapted to move about on the supporting surface;

at least two retractable booms, each with a suspension beam connection point, mounted on the vehicle and adapted to overhang the space to be scaffolded;

at least two suspension cables, one suspended from each boom;

a suspension beam adapted to be selectively connected to the suspension cables and the suspension beam connection points;

at least two vertical support columns suspended from the suspension beam;

a plurality of work platforms adapted to be connected at preselected levels to the vertical support columns; and means for suspending the platforms from the cables when the platforms are not connected to the columns, whereby the platforms may be vertically moved by means of the cables independently of the suspension beam and vertical columns when the beam is connected to the connection points of the booms.

15. The invention of claim 14 wherein the columns are provided with an internal channel communicating with a longitudinal slot, said columns also having pairs of holes therein at said preselected levels for receiving pins and wherein the work platforms are provided with runners adapted to slide within the channels and wherein pins are inserted through said pairs of holes and through the runners of individual platforms for supporting same.

16. The invention of claim 15 wherein the suspension beam may be connected to the connection points or the cables by means of pins.

17. The invention of claim 16 wherein the mobile vehicle comprises a frame mounted on castors to allow universal rolling motion of the frame on the roof surface, said frame having a front, a rear and sides; and further comprising:

at least one outrigger, pivotally mounted on the frame so as to be able to extend beyond the front and beyond a side thereof;

at least one telescoping arm provided with a counterweight on one end, its other end being mounted on the frame.

18. The invention of claim 17 wherein the castors are provided with brakes and are keyed to lock into predetermined positions for specific maneuvers to be performed by the roof vehicle.

19. The invention of claim 18 wherein the frame further comprises boom supports which maintain the telescoping booms elevated with respect to the supporting surface.

* * * * *